US006184837B1

(12) United States Patent
Lindenmeier et al.

(10) Patent No.: US 6,184,837 B1
(45) Date of Patent: Feb. 6, 2001

(54) WINDOWPANE ANTENNA COMBINED WITH A RESISTING HEATING AREA

(75) Inventors: Heinz Lindenmeier, Planegg; Jochen Hopf, Haar; Leopold Reiter, Gilching, all of (DE)

(73) Assignee: FUBA Automotive GmbH, Bad Salzdetfurth (DE)

( * ) Notice: Under 35 U.S.C. 154(b), the term of this patent shall be extended for 0 days.

(21) Appl. No.: 09/448,167

(22) Filed: Nov. 24, 1999

(30) Foreign Application Priority Data

Nov. 24, 1998 (DE) ..... 198 54 169

(51) Int. Cl.[7] ..... H01Q 1/32
(52) U.S. Cl. ..... 343/704; 343/713
(58) Field of Search ..... 343/704, 713, 343/711, 712; H01Q 1/32

(56) References Cited

U.S. PATENT DOCUMENTS 4,914,446 4/1990 Lindenmeier ..... 343/713
5,239,302 * 8/1993 Maeda et al. ..... 343/704
5,933,119 * 8/1999 Fujii et al. ..... 343/704
5,959,587 * 9/1999 McHenry et al. ..... 343/704
6,072,435 * 6/2000 Terashima et al. ..... 343/704

* cited by examiner

*Primary Examiner*—Hoanganh Le
(74) *Attorney, Agent, or Firm*—Collard &Roe, P.C.

(57) ABSTRACT

An antenna disposed in a windowpane of a motor vehicle having an electrically conductive motor vehicle body having a direct current heating source. Disposed on the windowpane of the car is at least one heating field having at least one bus bar disposed on one side of the heating field. Connected to the bus bar at a connection point is a feeding network for feeding heating current into the bus bar. The feeding network is installed adjacent to the windowpane and comprises at least one magnetic core. Mounted on the at least one magnetic core is a primary winding which has a sufficient number of turns to transfer the high frequency, high impedance connection of the heating field. In addition, there is also a field compensation winding mounted on the at least one magnetic core, and is connected to a compensating current source so that this connection has no substantial effect in reducing inductive high resistence of this feed network and thus the high frequency reception of the antenna.

24 Claims, 12 Drawing Sheets

WINDOWPANE ANTENNA COMBINED WITH A RESISTING HEATING AREA

BACKGROUND OF THE INVENTION

1. Field of the Invention

This invention relates to an antenna disposed on a windowpane of a motor vehicle having an electrically conductive motor vehicle body. The windowpane has a substantially rectangular or trapezoidal heating field that is provided on each side with a bus-bar and has bus-bar connections for feeding heating current on both sides. A heating direct current source is connected to the heating field and is electrically connected to the electrically conductive body of the motor vehicle. The current is fed on each side via an inductively high-resistance current feed network which is installed within proximity of the side edges of the windshield. The heating field is largely high-frequency insulated against the body of the motor vehicle with the help of current feed networks due to their high impedance so that the heating field can conduct high-frequency voltage, that is insulated from the body of the motor vehicle.

2. Description of the Prior Art

A heating field inductively connected in such a way can thus be designed as an antenna with the help of the current feed networks, as shown, for example in FIG. 1 of German Patent DE 36 18 452. The high-frequency coupling to a heating field conducting the high-frequency voltage, to form the antenna, can be accomplished, for example, by a connection to a bus-bar of the heating field.

It is found in automobile construction that interference signals frequently caused by the electronic noise of the automobile are coupled in via the longer current feed lines connected to the bus-bars without any HF-effective filter means. These interference signals disturb the reception in undesirable ways. The advantage offered by the current feed networks installed on the two sides near the bus-bar lies in the possibility of a high-frequency connection of the heating current feeds to the auto body on each side of the respective feed network, facing away from the heating field, without requiring the current to be conducted by longer lines on both sides of the heating field.

Furthermore, high-frequency impedance conditions can be defined on the bus bars. These conditions are not dependent upon the way in which the heating current lines are configured. However, the problems connected with this arrangement are in providing a inductance value for heating currents, with intensities of up to 30 A, particularly within the range of AM radio transmission. The required inductance cannot be realized in the conventional way with small antennas and with light-weight feed networks. The invention is based upon designing feed networks of high inductance that are constructed as small as possible. Also, at low frequencies, the feed networks should have efficient RF insulation, and have adequately low high-frequency losses and filament wattage losses.

SUMMARY OF THE INVENTION

The invention relates to an antenna disposed on a windshield of a motor vehicle having an electrically conductive body. The windshield antenna comprises a direct current heating source electrically connected to the motor vehicle body. Disposed on the windshield of the car is at least one heating field having a bus-bar disposed on one side of each heating field. Connected to the bus-bar at a connection point is a network for feeding heating current to the bus-bar. The network is installed adjacent to the windowpane and comprises at least one magnetic core. Mounted on the magnetic core is a primary winding which has a sufficient number of turns to transfer the high-frequency, high impedance connection of the heating field to the antenna. In addition, there is also a field compensation winding, mounted on the one magnetic core, and connected to a compensating current source so that this connection has no substantial effect in reducing the inductive high-impedance of this feed network.

In this case, the field compensation winding receives a flow of direct current so that the magnetic fields, resulting from the number of turns, their winding direction and the primary winding receiving the flow of heating current, act in an opposite direction relative to one another in the magnetic core. In addition, the magnetic fields are compensated for in the magnetic core, so that there is no interfering saturation effect, so that the antenna is formed either by the heating field itself or by a wire-shaped or flat conductor on the windowpane adjacent to the heating field.

BRIEF DESCRIPTION OF THE DRAWINGS

Other objects and features of the present invention will become apparent from the following detailed description considered in connection with the accompanying drawings which disclose several embodiments of the invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1A:
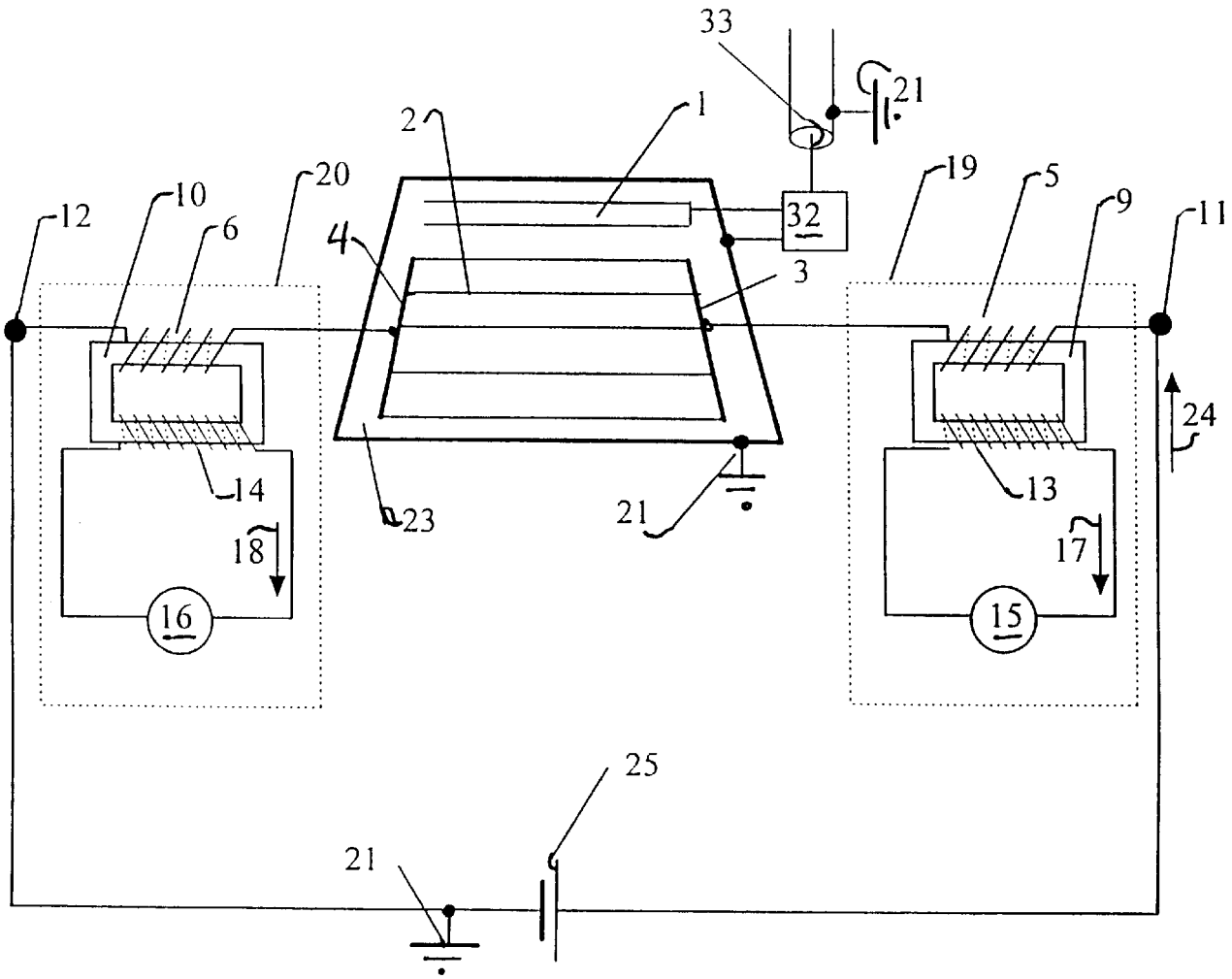
FIG. 1*a* shows a windowpane antenna having a feed network on each side of the heating field.

FIG. 1*a* shows the windowpane antenna of the invention, with feed networks 19 and 20 disposed on each side of a heating field 2. Feed networks 19 and 20 have magnetic cores 9 and 10, respectively, with primary windings 5 and 6 respectively, through which a heating current 24 flows. Field compensation windings 13 and 14 are mounted on cores 9 and 10, respectively, with the compensating direct currents 17 and 18 flowing through the compensation winding for generating compensating magnetic fields 17*a* and 18*a* that adequately compensate the primary magnetic field 24*a* of the heating field (see FIG. 4*b*).

The use of magnetic cores on both sides of the heating field is necessary in order to reduce the size of the antenna. The extremely high heating current 24 flowing in primary windings 5 and 6 of feed networks 19 and 20 leads to a saturation phenomena in magnetic cores 9 and 10 that must be avoided. As shown in FIG. 1*a,* this is accomplished with a field compensation winding 13, 14, through which the compensating dc current 17, 18 flows. This compensating direct current is adjusted so that the dc field in the magnetic cores 9 and 10 is compensated for by a set number of turns of field compensation windings 13 and 14. Compensating current source 15 and 16 must be designed, in this connection, with a high resistance, so that the inductance of primary windings 5 and 6 are not substantially reduced when compensating current sources 15 and 16 are switched on. Magnetic cores 9 and 10, designed without an air gap, are preferred so that primary windings 5 and 6 that are as small as possible, and with as little copper used as possible. Field compensation windings 13 and 14 can be designed in this connection as a winding with a thin wire, and a large number of turns, so that the product of compensating dc currents 17 and 18, and the number of turns, corresponds with the product of heating current 24 and the number of turns of primary windings 5 and 6. In FIG. 1*a,* a field 2*a* located closest to antenna 1 is needed, having hating current fed via feed networks 19 and 20.

Figure 1B:
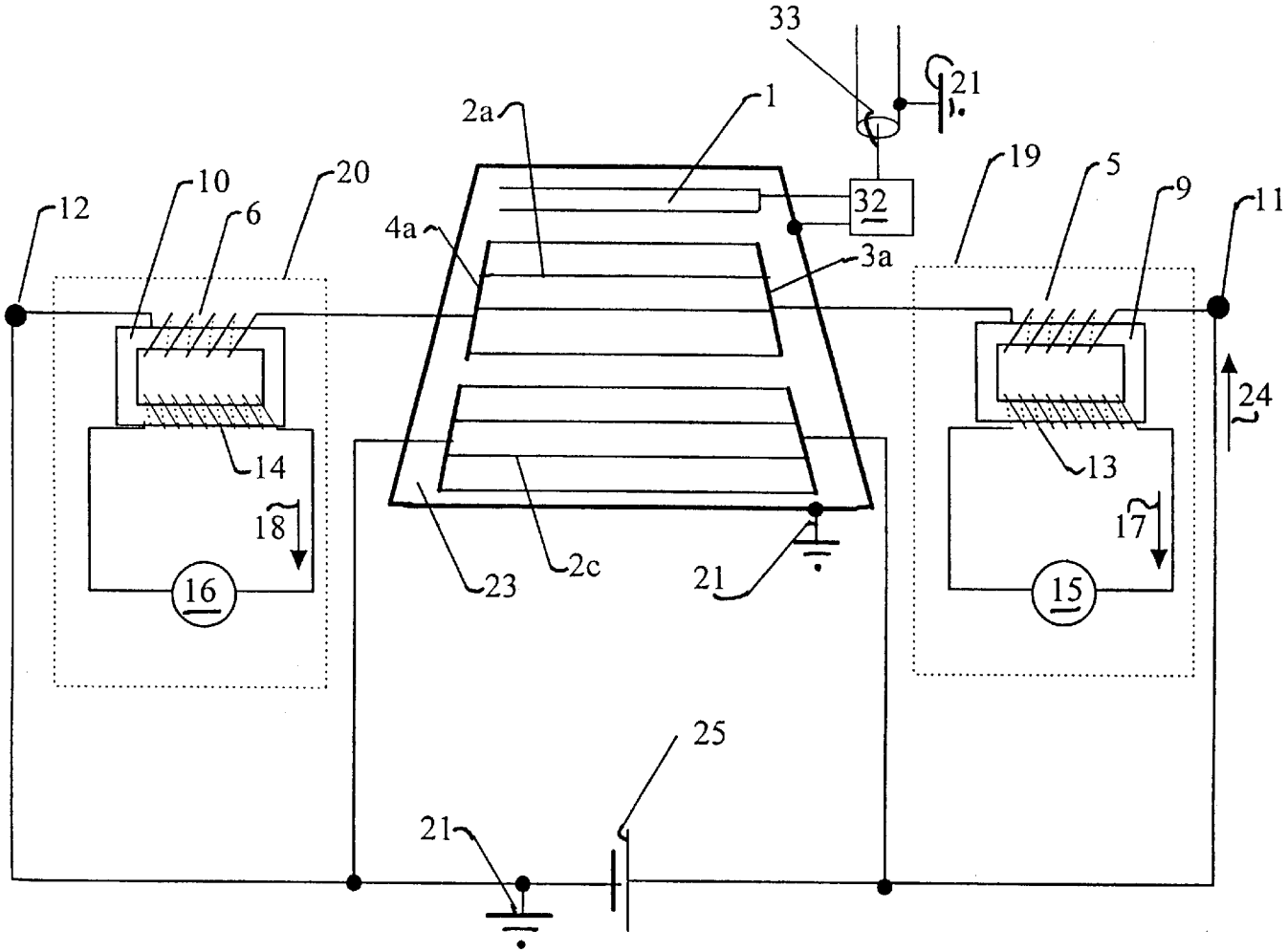
FIG. 1*b* shows the same arrangement as FIG. 1*a* except having a divided heating field with a T-fed network.

FIG. 1*b* shows the same arrangement as FIG. 1*a,* but with a divided heating field, the first partial heating field 2*a* being fed via feed networks 19 and 20, and whose further partial heating field 2*c* is grounded in terms of high frequency to vehicle body 21.

The embodiments of FIGS. 2*a* to 2*e* show different variations for adjusting the correct compensating dc currents 17 and 18 in field compensation windings 13 and 14, so that the magnetic fields are adequately compensated for.

Figure 2A:
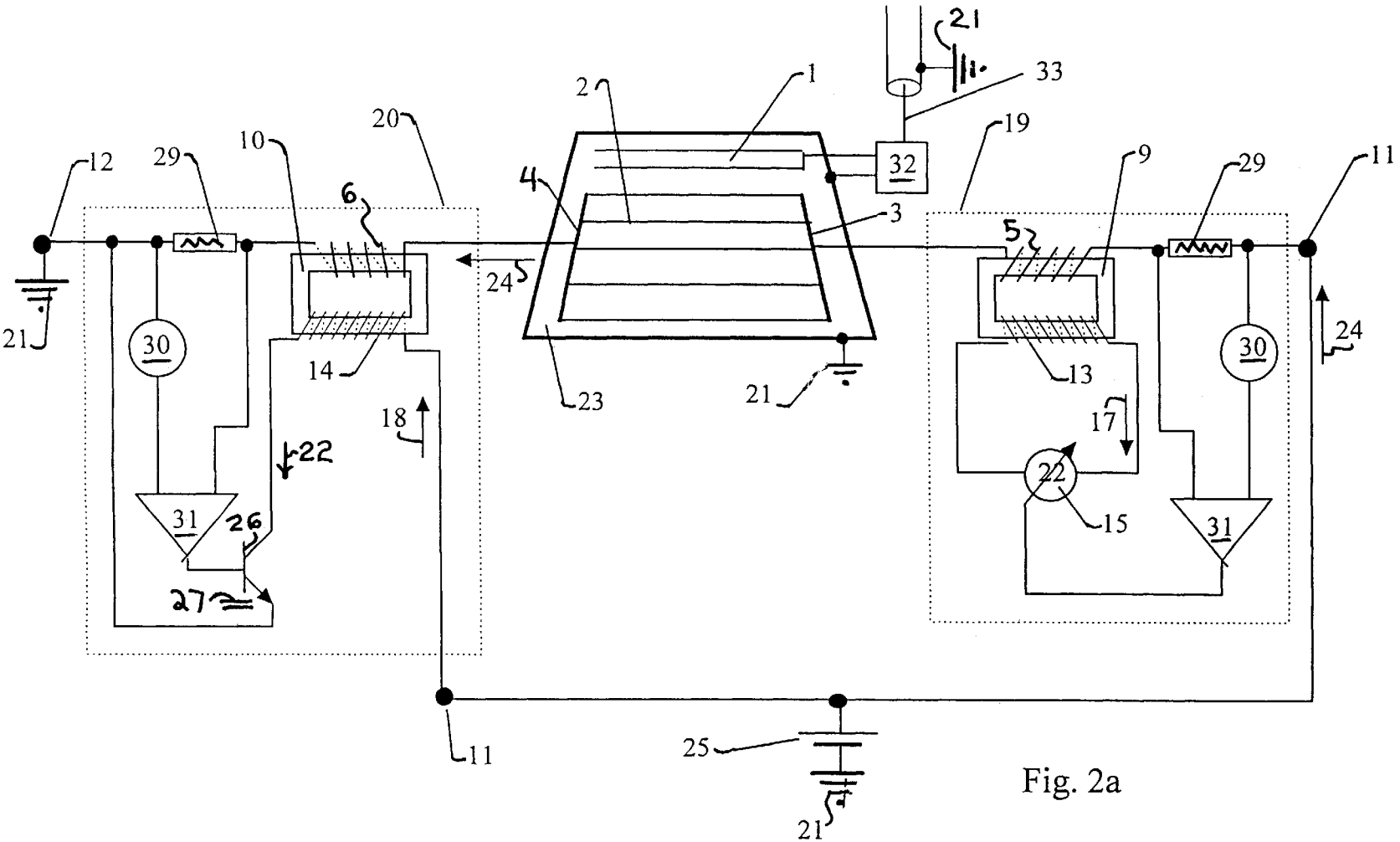
FIG. 2*a* shows a similar arrangement as FIG. 1*a* with a controller for setting the correct compensating current in each current feed network.

FIG. 2*a* shows an arrangement similar to FIG. 1*a,* with a controller for setting the correct compensating dc current 17 and 18 in current feed networks 19 and 20. FIG. 2*a* has a measuring resistor 29 on each side of the circuit. The voltage across each resistor 29, which is generated by heating current 24, is compared with the voltage of a rated-value emitter 30 on controller 31, and the output of controller 31 adjusts the controllable direct-current source 22. The direct current source is highly resistive at high frequency so that the required field of compensation is obtained with the preset field compensation windings 13 and 14, and primary windings 5 and 6. On the left-hand side of FIG. 2*a*, direct-current source 22 is controlled by a three-contact amplifier 26. High resistance at high frequencies is provided by the height resistance of the source-sink path 27 of the controllable three-contact amplifier 26.

Figure 2B:
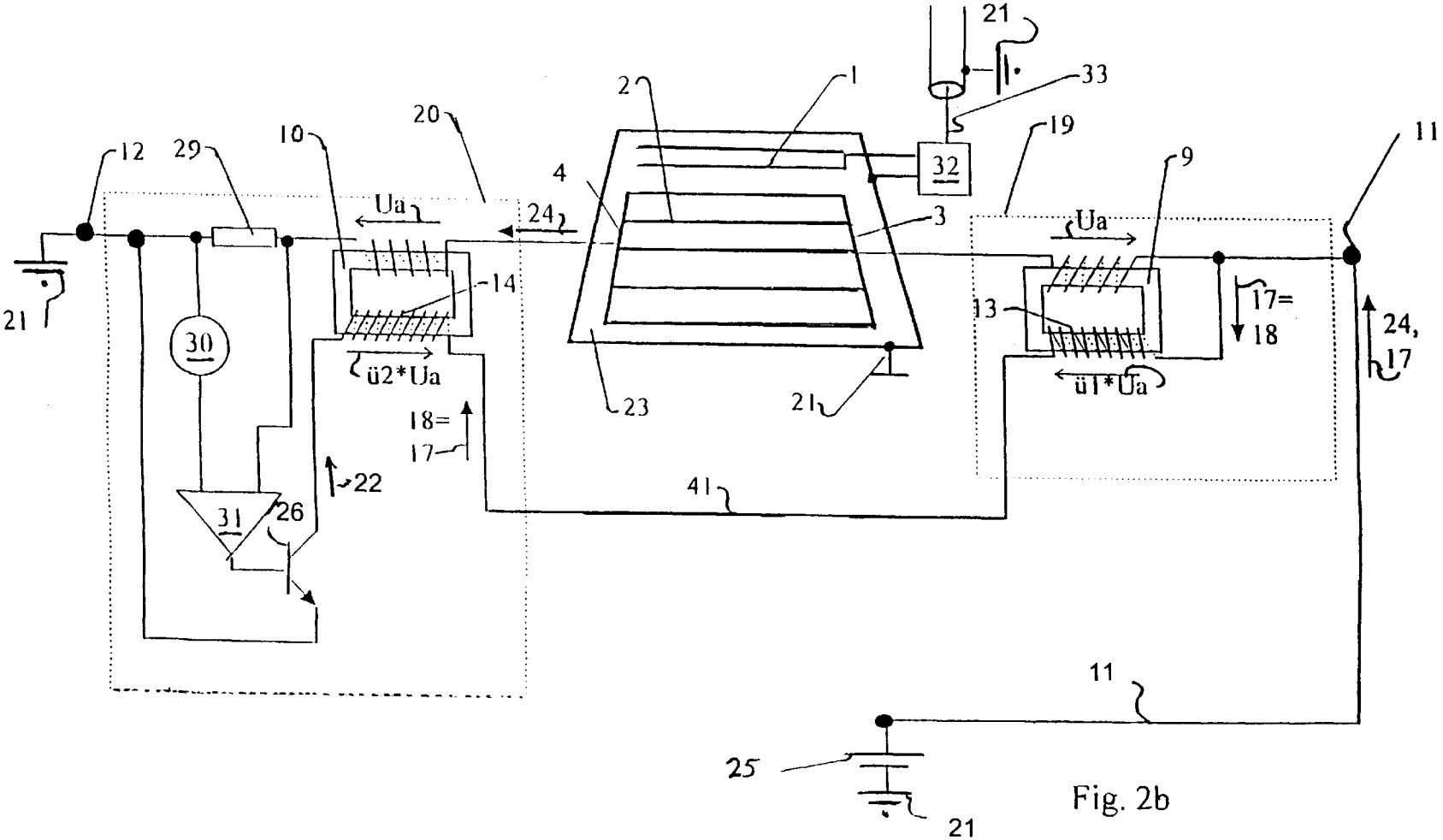
FIG. 2*b* shows a similar arrangement as FIG. 2*a* but with the same magnet cores disposed on both sides of the windowpane.

FIG. 2*b* shows an arrangement similar to FIG. 2*a*, with the same magnetic cores 9 and 10, primary windings 5 and 6, compensation windings 13 and 14, and with a controller 31 being present only on one side.

The two field compensation windings 13 and 14 here are connected via a connecting conductor 41, so that these windings are connected in series, with the same compensating dc current 17 and 18 flowing through both windings. In FIG. 2*b*, the heating current 24 is supplied from voltage connection 11 of dc heating source 25 to heating field 2. Heating field 2 is connected on the left-hand side to ground connection 12. With this type of heating current feed, heating current 24 in heating field 2 and compensating dc current 17 and 18 in cross-connecting conductor 41 flow in the same direction, from one side of windowpane 23 to the other. The compensating effect of the magnetic fields in magnetic cores 9 and 10 produces in the windings the effect so that when voltage Ua is developing on primary windings 5 and 6 in the direction shown, the secondary voltages ü1*Ua, ü2*Ua each develop on field compensation windings 13 and 14 in the opposite direction. Compensating dc currents 17 and 18 are usefully selected based on a high number of turns in field compensation windings 13 and 14 so that it is substantially smaller than heating current 24, and thus ü1 and ü2 are substantially greater than 1.

Figure 2C:
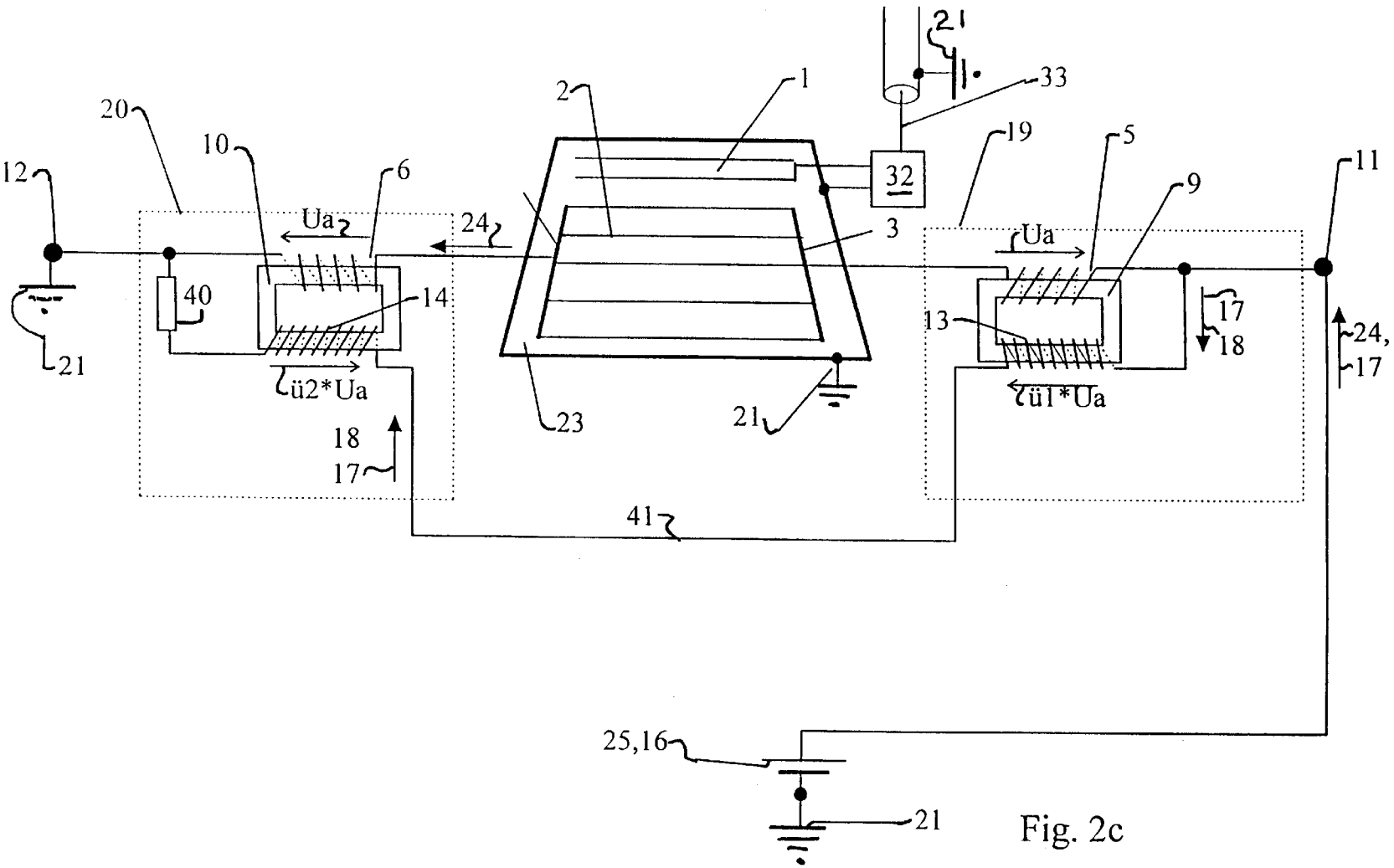
FIG. 2*c* shows a similar arrangement as FIG. 2*b* with a compensating direct current that is fixed with the help of a compensating resistor.

FIG. 2*c* shows an arrangement similar to FIG. 2*b*, with compensating direct-currents 17 and 18 being fixed with the help of a compensating resistor 40. The controllable three-pole amplifier 26 is thus replaced by compensating resistor 40. This is possible when the voltages on field compensation windings 13 and 14 are equal, and occurs when the ratios of turns in feed networks 19 and 20 have identical values (ü1=ü2). In this case, the high resistance dc source can be replaced by a low-resistance source.

Figure 2D:
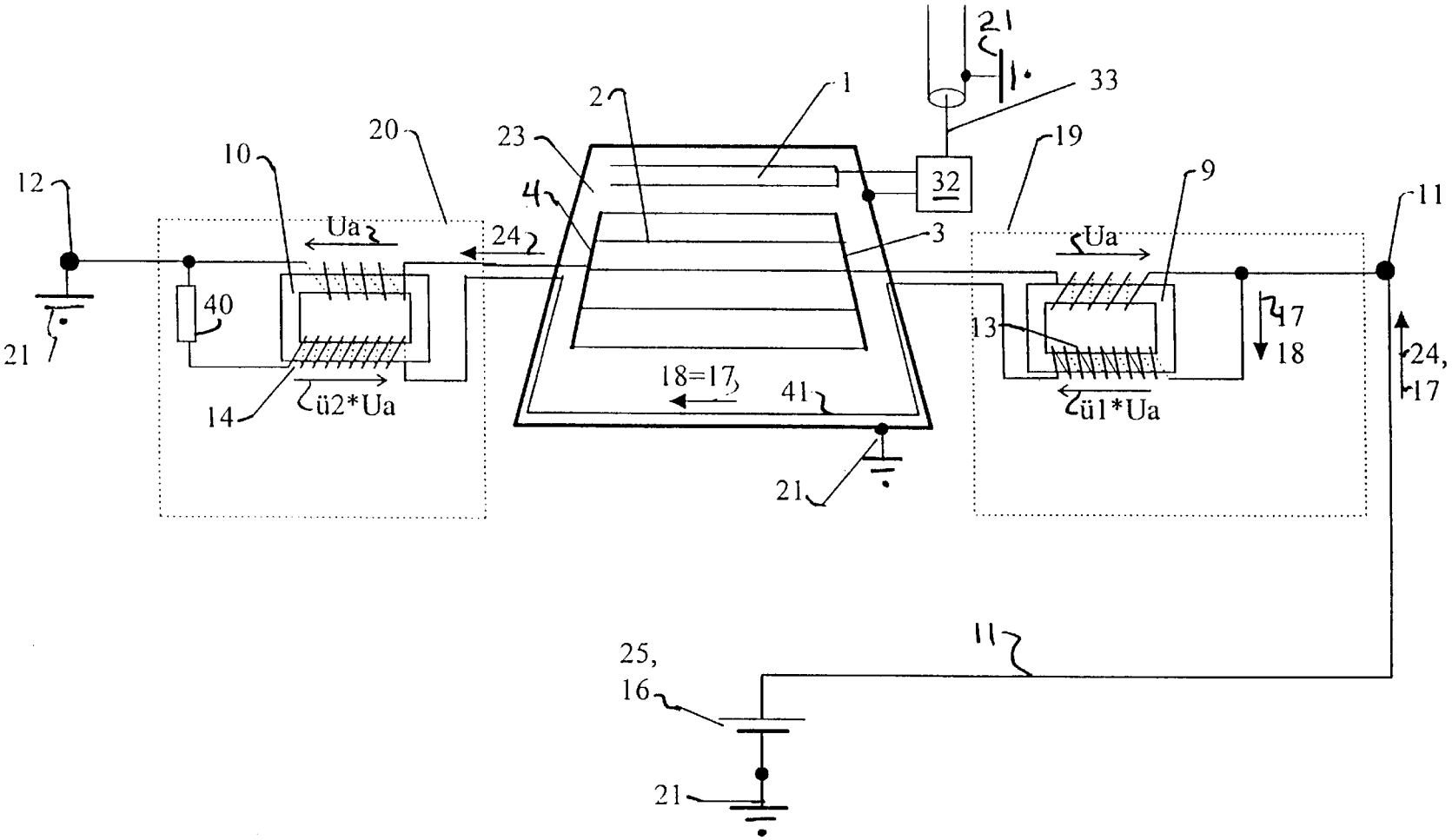
FIG. 2*d* shows a similar arrangement as FIG. 2*c* except that the compensating direct current flows in a connecting conductor in the opposite direction of the flow of heating current, from one side to the other side of the windowpane.

FIG. 2*d* shows an arrangement similar to FIG. 2*c*, wherein the compensating direct currents 17 and 18 flow in connecting conductor 41 in the opposite direction of the flow of heating current 24, from one to the other side of windowpane 23, and the number of windings and the direction of the windings in field compensation windings 13 and 14 are selected so that the required compensation of the magnetic excitation caused by heating current 24 is effected in magnetic cores 9 and 10. Connecting conductor 41 is imprinted on the windowpane and installed with adequate spacing from heating field 2. Compensating direct currents 17 and 18 flow through connecting conductor 41 in the same direction as heating current 24 in heating field 2. Connecting conductor 41 conducts high-frequency voltage which, as compared to heating field 2, is oppositely directed as against auto body 21. For this reason, the capacitive coupling between connecting conductor 41 and heating field 2 should be kept as low as possible. Thus, the physical spacing between connecting conductor 41 and heating field 2 should be adequately large.

Figure 2E:
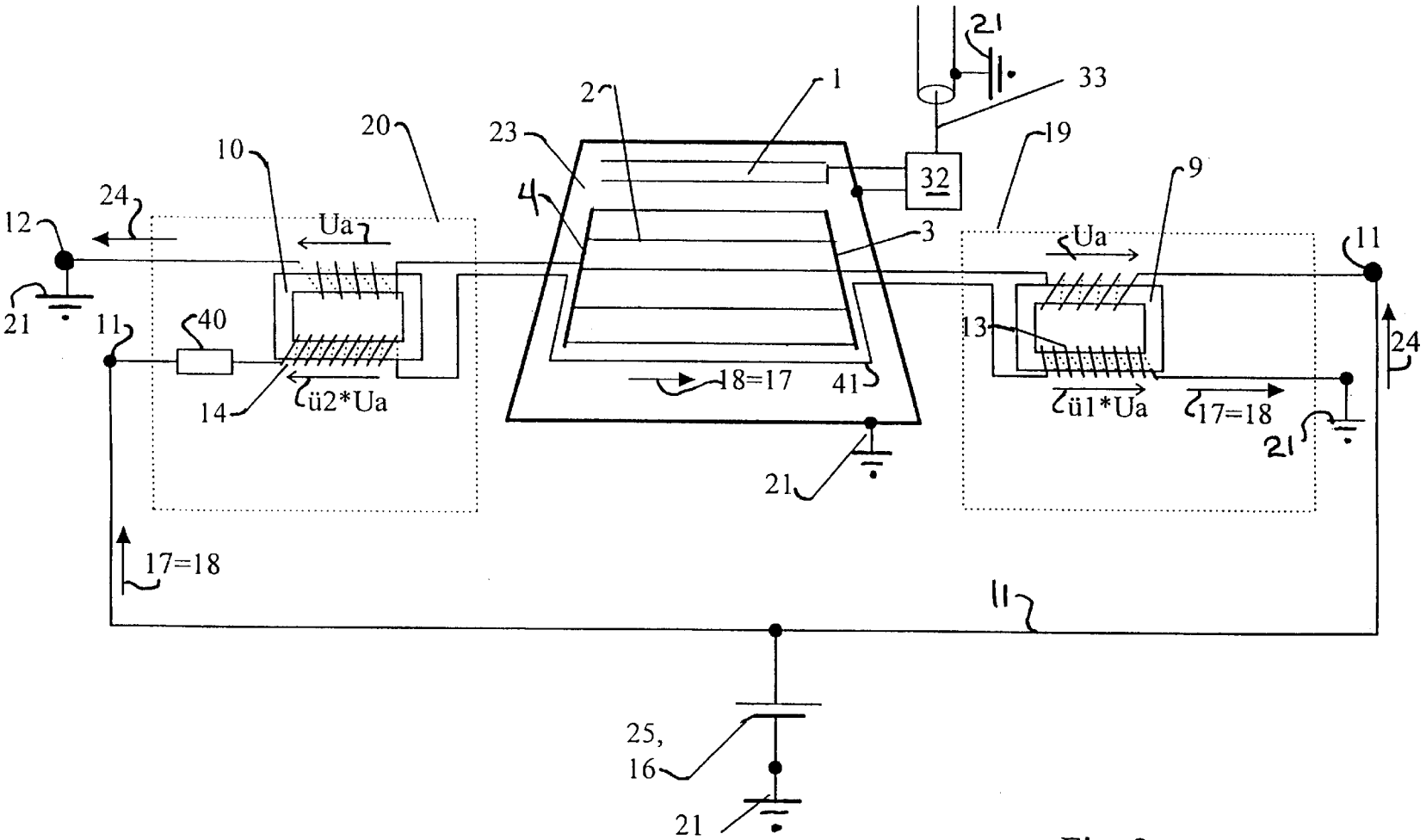
FIG. 2*e* shows a similar arrangement as FIG. 2*d* except that both sides of the magnetic cores are grounded.

If voltage connection 11 and ground connection 12 are made available on each of the two sides of the heating field, a type of connection as shown in FIG. 2*e* is possible.

FIG. 2*e* shows an arrangement similar to FIG. 2*d*, wherein compensating dc sources 17 and 18 flow in connecting conductor 41 in an opposite direction as heating current 24, and the number of windings and the direction of the windings in field compensation windings 13 and 14 are in each case selected so that the required compensation is adjusted, or set. Connecting conductor 41 is imprinted on the windowpane and located with adequate spacing from the conducting frame of the window. Thus, the associated fields in the magnetic cores 9 and 10 compensate each other if the correct winding direction is selected for primary windings 5 and 6 and field compensation windings 13 and 14. The voltages developing on primary windings 5 and 6 and on field compensation windings 13 and 14 will then have the same direction, as shown in FIG. 2*e*. In this case, the capacitance between connecting conductor 41 and heating field 2 will be less damaging.

The invention is of special importance in connection with radio transmission services at where the dimensions of windowpane 23 are smaller than the received wavelengths by at least one order of magnitude. The inductive effects of heating field 2 are then negligible, and the heating field will serve as a quasi-potential surface. In a particularly advantageous embodiment of the invention, the connecting conductor 41 is designed in the form of a partial heating field, for example in the form of the second partial heating field 2*b* as shown in FIG. 3.

Figure 3:
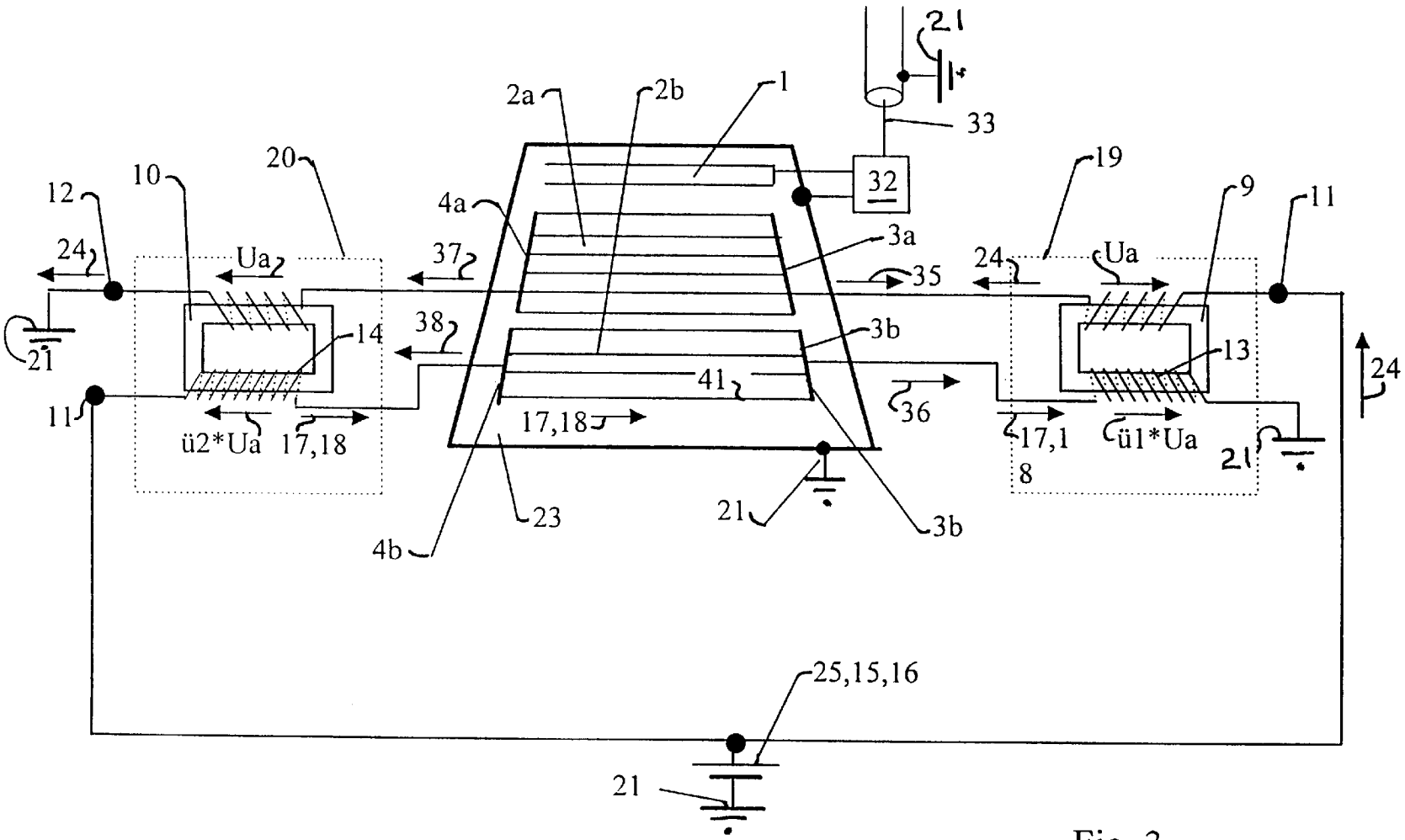
FIG. 3 shows an arrangement similar to FIG. 2*e* except that the heating field is divided into first and second partial heating fields.

FIG. 3 shows an arrangement similar to that of FIG. 2*e*, with the heating field 2 divided into a first partial heating field 2*a* and a second partial heating field 2*b*. The compensating direct current 17, 18 is conducted in the opposite direction of the flow of heating current 24 in the first partial heating field 2*a* by the suitably poled connection of partial heating field 2*b* to the heating dc current source 25. For this purpose, ground connection 12 and voltage connection 11 of heating dc source 25 are required on both sides of the windowpane. The number of turns and the direction of the windings of primary windings 5 and 6 and field compensation windings 13 and 14 are selected so that the heating current primary magnetic field 24*a*, generated by the heating current, and the compensating magnetic fields 17*a* and 18*a*, generated by the compensating dc current, largely compensate one another in magnetic cores 9 and 20. The magnetic effects of the inductive HF-current of the first partial heating fields 35 and 37, and of the inductive HF-current of the second partial heating fields 36 and 38, the latter HF-current being directed in the same direction as the former, support each other in magnetic cores 9 and 10.

Particularly favorable dimensioning is obtained if the heating field is divided in two approximately equal sized partial areas so that the ratio of turns ü1, ü2 between primary windings 5 and 6 and field compensation windings 13 and 14 have the value ü1=ü2=1. Then, the compensating direct current 17, 18 in the second partial heating field 2*b* will have about the same value as the heating current 24 in the first partial heating field 2*a*. In this arrangement, it is necessary that both voltage connection 11 and ground connection 12 are available on both sides of the windowpane. In the circuit shown in FIG. 3, heating current 24 and compensating direct current 17, 18 in the two adjacent partial heating fields flow in opposite directions relative to each other. If primary windings 5 and 6 and field compensation windings 13 and 14 are identically designed on the two sides of windowpane 23, the magnetic fields in the magnetic cores 13, 14 will cancel each other. With equally sized partial heating fields and the same type of design of feed networks 19 and 20 on both sides of the windowpane, the capacitance Ck between the first partial heating field 2*a* and the second partial heating field 2*b* will not affect the HF-voltage developing on primary windings 5 and 6 and field compensation windings 13 and 14.

Figure 4A:
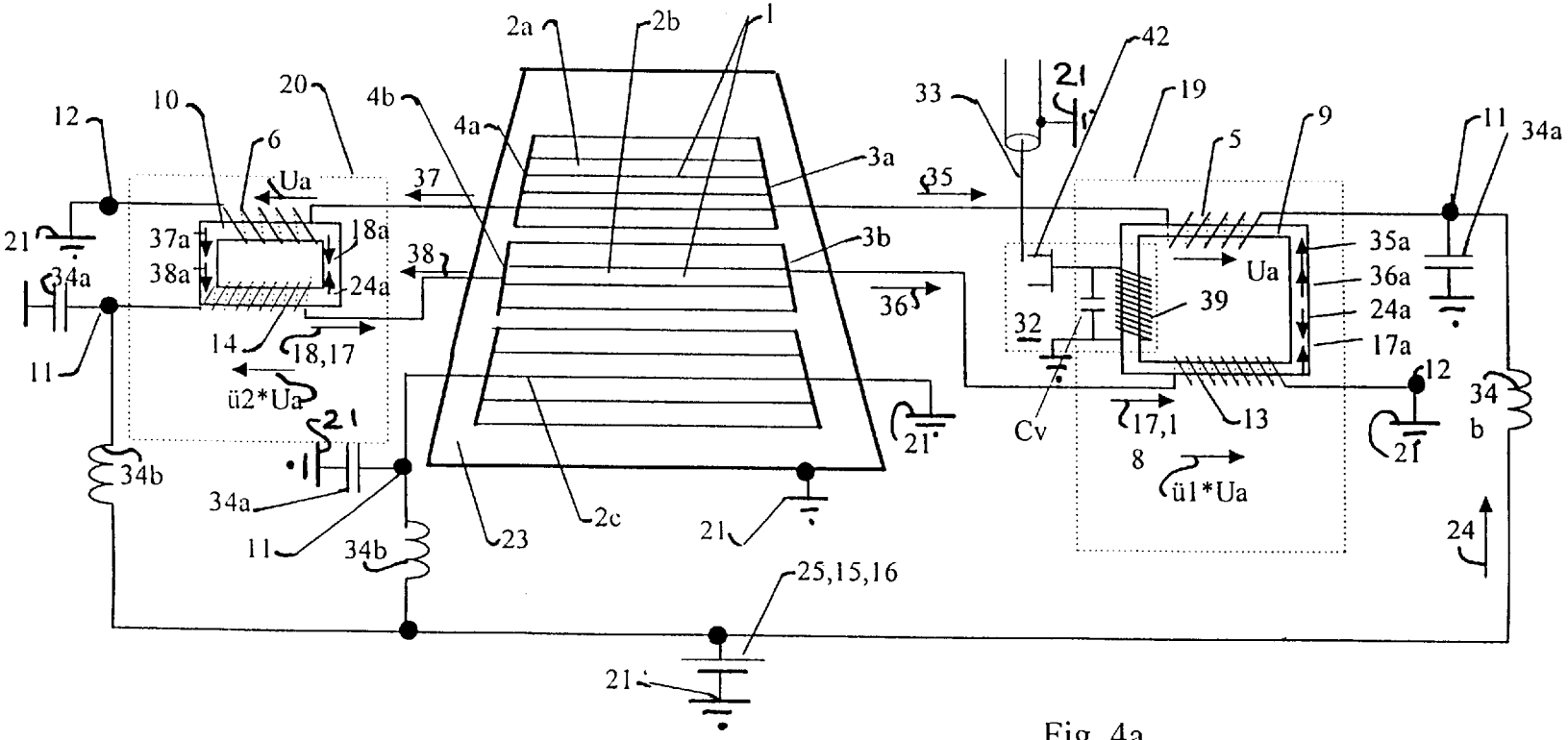
FIG. 4*a* shows the same arrangement as in FIG. 3 with a third partial heating field.
Figure 4B:
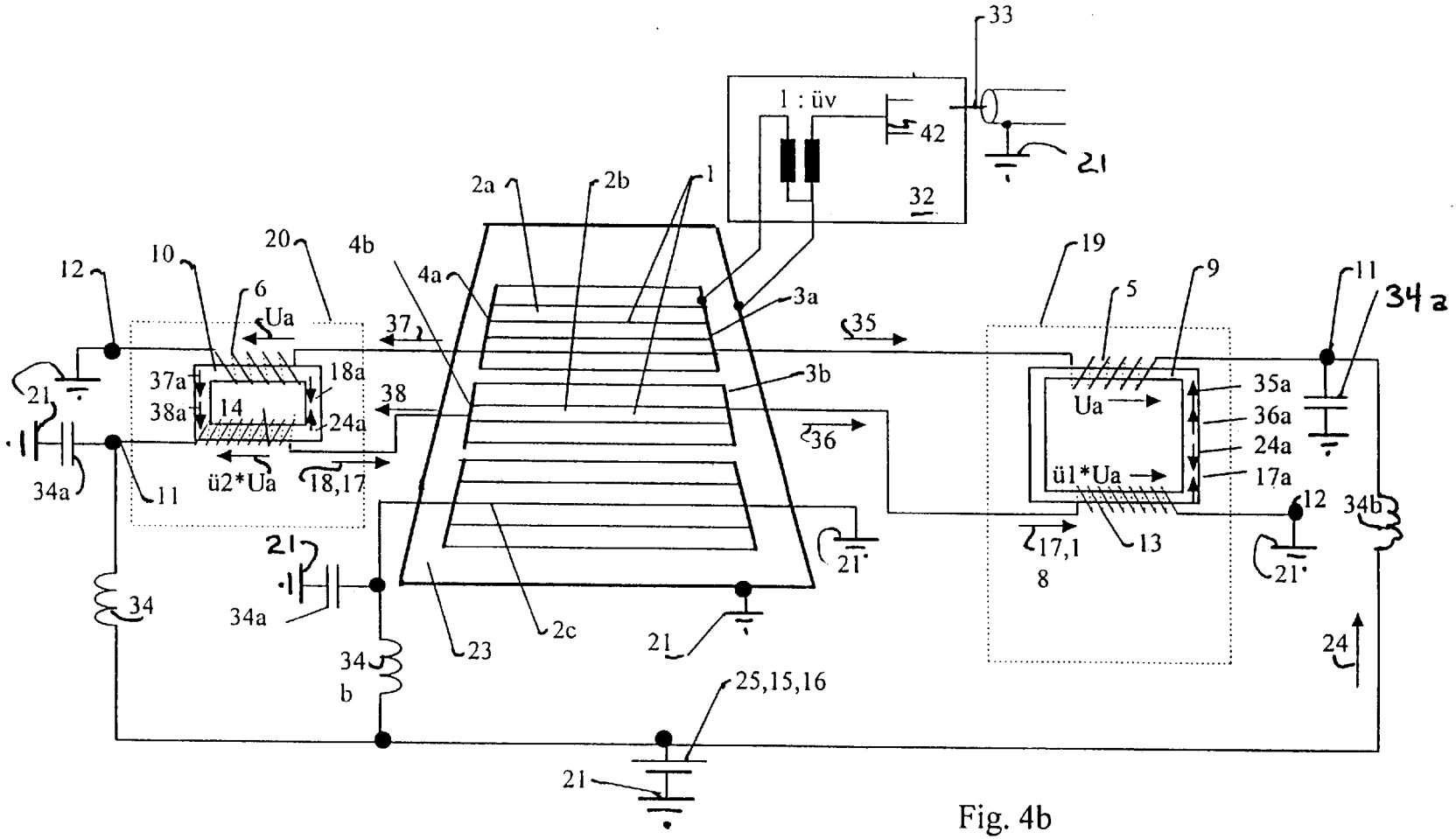
FIG. 4*b* shows an arrangement similar to FIG. 4*a* except that it provides a decoupling of the antenna signal by connecting the third antenna circuit to a bus-bar.

FIGS. 4*a* and 4*b* show different ways of decoupling the antenna voltages.

FIG. 4*a* shows an arrangement similar to FIG. 3, with a first partial heating field 2*a*, a second partial heating field 2*b*, and with an additional partial heating field 2*c* which is grounded in terms of high frequency. The connections to voltage connection 11 are made in each case via a filter reactor or coil 34*b*, and the high frequency grounding is made via a filter capacitor 34*a*. The antenna signal is decoupled via a decoupling winding 39 located on the magnetic core 9 or 10 in the further-conducting antenna circuit 32.

In FIG. 4*a*, a transmitter, located between the primary winding 5 and the field compensation winding 13 on the common magnetic core 9, is supplemented by the decoupling winding 39. Decoupling winding 39 is loaded with the effective capacitance Cv of amplifying electronic circuit 42 in the further-conducting antenna circuit 32. The amplified antenna signals are available in antenna connection line 33. To explain the mode of operation, the inductive HF-current of the first partial heating field 35, 37, and the inductive HF-current of the second partial heating fields 36 and 38 are shown on both sides of windowpane 23. These currents flow through the primary windings 5 and 6 and field compensation windings 13 and 14, and they generate in magnetic cores 9 and 10 the HF primary magnetic field 35*a*, 37*a*, and, respectively, the HF secondary magnetic field 36*a*, 38*a*. The HF primary magnetic field 35*a*, 37*a* and the HF secondary magnetic field 36*a*, 38*a* each are equally directed in magnetic cores 9 and 10. These fields support each other in forming the inductance for the high-frequency insulation of the two partial heating fields against body 21 of the motor vehicle. This type of connection for the heating current has voltage connection 11 and ground connection 12 available on both sides. The heating currents 24 and 17 are directed opposite each other in the two partial heating fields 2*a* and 2*b*. In addition, the associated heating-current primary magnetic field 24*a* and the compensating magnetic field 17*a* and, respectively, 18*a*, are then directly opposing each other, and cancel one another out. In view of electromagnetic compatibility, voltage connections 11 in FIG. 4*a* each are supplied with filtered voltage by the filter choke 34*b* in association with filter capacitor 34*a*. This applies also to further partial heating field 2*c*, which becomes grounded at high frequency, and connected on one side to ground connection 12, and supplied with filtered voltage on the other side of voltage connection 11. Mounting the filter capacitors 34*a* and voltage connections 11 near the bus-bars of the heating fields is advantageous in view of preventing interference from being coupled in via the on-board network.

FIG. 4*b* shows an arrangement similar to FIG. 4*a*, except there is a decoupling of the antenna signal by connecting the further-conducting antenna circuit 32 to a bus-bar 3*a* of the first partial heating field 2*a* with the help of a transmitting element with a suitable ration of windings üv.

In FIG. 4*b*, the antenna signals are decoupled from a first partial heating field 2*a*—which is insulated in terms of high frequency—via the primary windings 5 and 6, with the help of a transmitter with ratio of windings üv, and transmitted to the further-conducting antenna circuit 32. Decoupling takes place between the bus-bar of the first partial heating field 3*a* or 4*a*, and body 21 of the vehicle. Again, with the same number of turns of primary windings 5 and 6 and field compensation windings 13 and 14, the HF-voltages on the first partial heating field 2*a* have to be equal to those on the second partial heating field 2*b*. Thus, the transmitter located in the further-conducting antenna circuit 32 could also be connected to one of the bus-bars 3*b*, 4*b* of the second partial heating field 2*b*.

Figure 5:
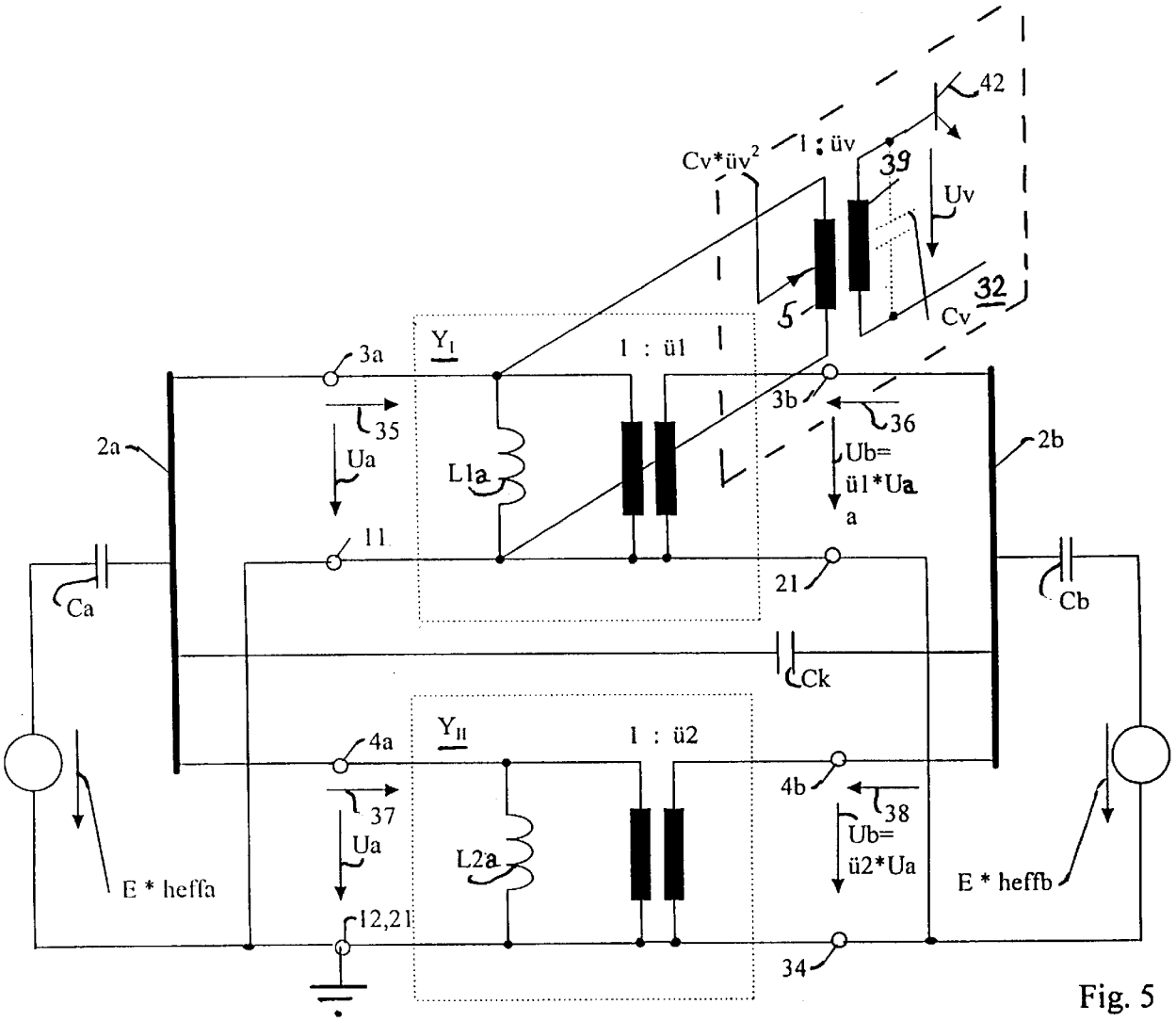
FIG. 5 shows an electric substitute circuit diagram of the arrangement shown in FIG. 4*b* for receiving low-frequency signals.

FIG. 5 shows an electrical equivalent circuit diagram of the arrangement shown in FIG. 4*b* for low-frequency received signals (e.g., in the AM frequency range). Coils L1*a* and L2*a* form the inductances based on primary winding 5 and, respectively, primary winding 6, with field compensations windings 13 and 14 being on open-circuit. The ratios of windings ü1 and ü2 each result from the ratios of the numbers of turns of field compensation winding 13 and, respectively, 14 to primary windings 5 and 6, respectively. Rigid coupling with negligible scatter is assumed between the two windings in each case. The first partial heating field 2*a* and the second partial heating field 2*b* each are shown by the thick lines, which show that the received voltage of the heating fields is the same on the left-hand and right-hand sides of windowpane 23. The voltage Ua of the first partial heating field 2*a* and the voltage Ub of the second partial heating field 2*b* are determined via the ratio of windings ü1. The ratio of windings is given by the ratio of the number of turns of primary windings 5 and 6 to the number of turns of field compensation windings 13 and 14 on the right-hand side, and by the excitation E*heffa for the first partial heating field 2*a* with its self-capacitance Ca, and by excitation E*heffb for the second partial heating field 2*b* with its self-capacitance Cb. Furthermore, capacitance Ck is effective as a coupling capacitance between the two heating fields. The connection of transmitter uv for decoupling the antenna signals Uv via decoupling winding 39 is connected in parallel with the first partial heating field 2*a*. As the received signals are flowing in, such an inflow being effected by the electromagnetic field intensity E, the self-inductance L1*a* of the primary winding 5 and its loss factor δ1*a* are important on the right-hand side of windowpane 23. In addition, this also depends upon the self-inductance L2*a* of primary winding 6, and its loss factor 62*a* on the left-hand side.

In the special case where the first and second partial heating fields 2*a* and 2*b* are equally sized, and identical primary windings 5 and 6 are present on both sides of windowpane 23, field compensation windings 13 and 14 can also be designed the same way as primary windings 5 and 6. The following applies approximated in the application of such a particularly important case:

Ca=Cb=C, ü1=ü2=1, L1*a*=L2*a*=La=L, δ1*a*=δ2*a*=δa=δ, and heffa=heffb=heff.

With inclusion of a suitable value for uv, particularly favorable signal/noise ratios can be obtained under real conditions. This occurs at the output of amplifying electronic element 42 if the available total surface area for the first and second partial heating fields 2*a* and 2*b* is preset. In this case, Ua=Ub, and Ck has practically no effect. The system is optimized under such preconditions by creating an adequately high inductance L with a loss factor δ as low as possible. This is important particularly at the lower end of the frequency band for which the arrangement is conceived. With each of the two inductance, the loss factor represents a conductance loss factor of δ/(ωL), whose flow of noise into the parallel circuit substantially co-determines the signal-to-noise ratio obtained, especially at low frequencies.

In the following, the signal/noise ratio is determined on the output of the amplifying electronic element 42 in FIG. 5. This is in the case that is to be preferred in practical use, where identically designed primary windings 5 and 6 and identical field compensation windings 13 and 14 are present on both sides of windowpane 23. However, the second partial heating field 2*b* has to be designed differently from the first partial heating field 2*a*. Therefore, the variables are as follows:

Ca; heffa; Cb; heffb; ü1=ü2=ü, L1*a*=L2*a*=L, δ1*a*=δ2*a*=δ. RT is the equivalent noise resistance of amplifying electronic element 42 with its effective capacitance Cv, and üv is the transmission ratio of the coupling. Resonance frequency fr results from the antenna capacities and capacitance Cv with inclusion of the winding capacitances and the two inductances L.

$$2\pi fr = \sqrt{\frac{2}{L\cdot[Ca+\ddot{u}^2\cdot Cb+(1-\ddot{u}^2)\cdot Ck+\ddot{u}v^2\cdot Cv]}}$$

The relative signal/noise ratio, as compared to an active antenna with a received structure with capacity CA, an effective height h, and with an identical electronic amplifying element 42 with an effective capacitance Cv, and thus with an equivalent noise resistance RT, follows from the following equation:

$$SNRrel = \frac{\left[\frac{2\cdot\pi\cdot fr\cdot(heffa\cdot Ca+\ddot{u}\cdot heffb\cdot Cb)^2}{Ca+\ddot{u}^2\cdot Cb+(1-\ddot{u}^2)\cdot Ck+\ddot{u}v^2\cdot Cv}\cdot\left(\frac{1}{\delta}+\delta\right)\cdot\left(\frac{f}{fr}\right)^3\right]\cdot\frac{RT}{h^2}\cdot\left(1+\frac{Cv}{CA}\right)^2}{1+\frac{RT}{\ddot{u}v^2}\cdot\left[\frac{\left(1-\frac{fr^2}{f^2}\right)^2}{\delta}+\delta\right]\cdot\left(\frac{f}{fr}\right)^3\cdot 2\cdot\pi\cdot fr\cdot[Ca+\ddot{u}^2\cdot Cb+(1-\ddot{u}^2)\cdot Ck+\ddot{u}v^2\cdot Cv]}$$

Figure 6:
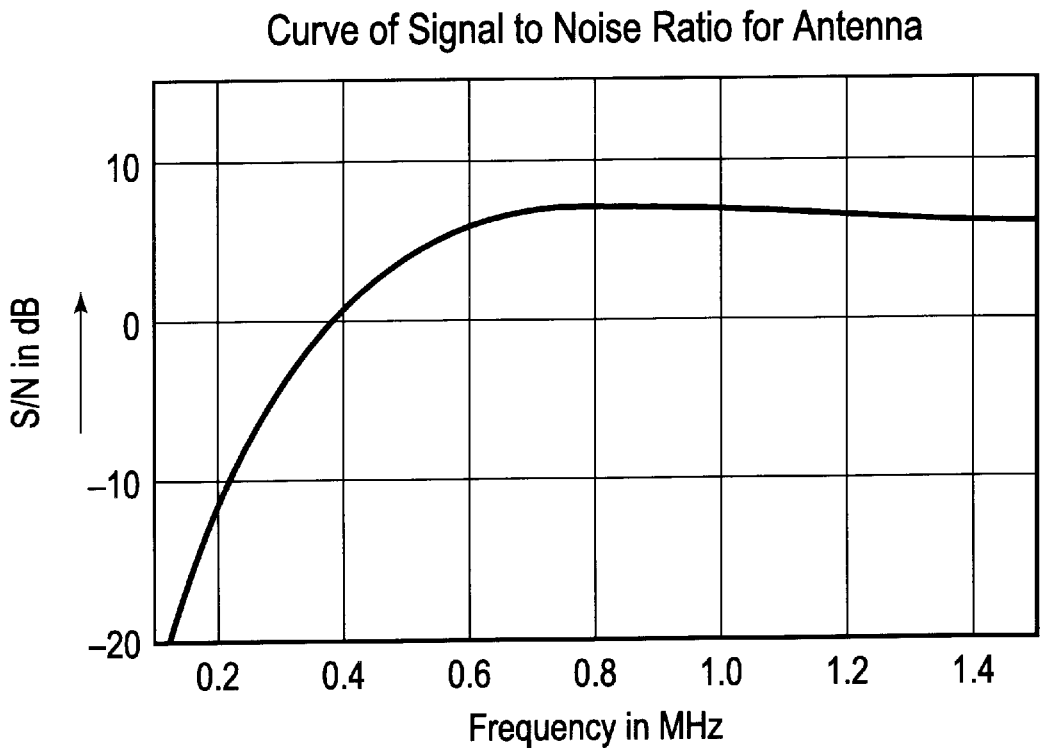
FIG. 6 is a plot of the signal to noise ratio in dB, and frequency in MHz of an antenna receiving a medium wave radio transmission.

FIG. 6 shows, by way of example, the curve of the relative signal/noise ratio in dB. Optimal values can be obtained in this example with üv=3 and ü=1. It was assumed in this example that the values for the effective heights heffa=heffb=10 cm, and CA=120 pF, was put equal to (Ca+Cb)=120 pF. The curve shows that with a sufficiently high quality (δ=0.045) of the inductance being chosen for fr=0.5 MHz, the S/N ratio can be enhanced versus the test arrangement by feeding the heating current as defined by the invention with the help of transformative coupling of electronic amplifier 42 of FIG. 5, with an equivalent noise resistance of RT=50 ohms and an input capacitance Cv=10 pF.

Magnetic cores (9, 10) are preferably made from a highly permeable, low-loss material (δ=0.045) at high frequencies with a closed iron path without any air gap. For example ferrite material Fi 262 (by Vogt).

The two primary windings (5 and 6) and the two field compensation windings (13 and 14) can each be designed as bifilar windings with wires extending parallel to each other.

The further conducting antenna circuit (32) can be designed to receive a plurality of frequency ranges in the long, medium and short wave and ultra short wave ranges, and in the television range.

Accordingly, while several embodiments of the present invention have been shown and described, it is to be understood that many changes and modifications may be made thereunto without departing from the spirit and scope of the invention as defined in the appended claims.

What is claimed is:

1. An antenna disposed on a windowpane of a motor vehicle having an electrically conductive motor vehicle body and a source of DC power (25) from an on-board electrical system comprising:

a) at least one heating field disposed on said windowpane (23); and b) at least two feeding networks (19, 20) for feeding heating current (24) into said heating field (2) wherein each of said feeding networks comprises:

i) at least one magnetic core (9, 10);

ii) a primary winding (5, 6) mounted on said magnetic core, (9, 10) said primary winding (5, 6) having a sufficient number of turns to provide a high frequency high resistence connection to said heating field (2);

iii) at least one field compensation winding (13, 14) mounted on said at least one magnetic core (9, 10);

iv) a compensating current source (15, 16) is connected to said field compensation winding having no substantial effect in reducing inductive high resistance of said feeding network (19, 20), said field compensation winding (13, 14) receiving a flow of compensating direct current from said current source so that the magnetic fields resulting from the number of turns and direction of turns of the field compensation windings (13, 14) and said primary winding (5, 6) receiving the flow of heating current and said compensating current acting in an opposite direction relative to one another in said magnetic core so as to compensate the magnetic fields in said magnetic core so that there is no interfering magnetic core saturation effect, whereby the antenna is formed either by said heating field (2) or by a separate wire-shaped or flat conductor (1) on the windowpane (23) adjacent to said heating field.

2. The antenna according to claim 1, wherein said heating field (2) contains at least two partial heating fields comprising at least one first partial heating field (2*a*) that is connected to said feed network (19, 20), and at least one additional partial heating field high-frequency connected to the motor vehicle body (21), said additional partial heating field receiving dc power from the on-board electrical system.

3. The antenna according to claim 1, wherein said at least one magnetic core (9, 10) is highly permeable and made from a material having a low loss at high frequencies and having a closed iron path without an air gap.

4. The antenna according to claim 1, wherein said primary winding (5, 6) is formed by an electrical wire conductor having a diameter larger than said field compensation winding (13, 14), the primary winding having a lower number of wire turns than the field compensation winding (13, 14) so that the field compensation winding (13, 14) has a substantially greater number of turns and a thinner wire, wherein the compensating direct current impressed into said field compensation winding contains a suitable direction of flow by adjusting the heating DC source (25), and is selected with such intensity that the product of the respective current and the number of turns in the primary winding (5, 6) and the field compensation winding (13, 14) is approximately the same.

5. The antenna according to claim 1, wherein the magnetic core (9, 10) is mounted on both sides of the windowpane, wherein each magnetic core has identical primary windings (5, 6) so that said two feed networks (19, 20) have approximately identical inductance.

6. The antenna according to claim 1, further comprising a controllable direct current source (22), wherein said compensating current source (15, 16) is formed by said controllable direct current source (22) with applied compensating dc current (17, 18) from the dc power source and has a high impendence at high frequency.

7. The antenna according to claim 6, further comprising a current measuring device for measuring the heating current (24), comprising a resistor (29) in series with the heating current, a set-value emitter (30) connected to one side of said resistor, and a current controller (31) having one input connected to said emitter and a second input connected to the other side of said resistor (29), a three-pole control element (26) connected to the output of controller (31), wherein the set value of emitter (30) and the heating current (24) are compared in said controller (31) so that the compensating field direct current (17, 18) is regulated by said controllable three-pole element (26) in accordance with a predetermined set value determined by the given numbers of wire turns of said field winding (13, 14) for compensating the constant magnetic fields in said magnetic core (9, 10).

8. The antenna according to claim 6, comprising a pole element (26) and a source-sink path 27, and wherein said controllable direct current source (22) has a high frequency resistance that is formed by the source-sink path (27) of said controllable three-pole element (26) with the adjusted static current (28) forming the compensating dc current (17, 18).

9. The antenna according to claim 1, wherein said two field compensation windings (13 and 14) are located on different sides of the windowpane, a connecting conductor (41) for connecting said windings (13 and 14) in series so as to receive the same compensating direct current (17, 18), and wherein the direction of the winding of each field compensation winding (13, 14) is selected so that the heating current primary magnetic field (24*a*) generated by the primary winding (5, 6), and the compensating magnetic field (17*a*, 18*a*) are directed opposite to each other.

10. The antenna according to claim 9, further comprising a voltage connection (11) disposed on the windowpane for connecting the direct current feed to said primary winding (5, 6) and to said field compensation winding (13, 14) of the same magnetic core (9 or 10), so that the heating current (24) in said heating field (2) and the compensating direct current (17, 18) in said connecting conductor (41) flow in the same direction.

11. The antenna according to claim 10, wherein said voltage connection (11) serves as the feed of the direct current (24) to the primary winding located on the side of the windowpane (23) adjacent said voltage connection (11) on one side of the windowpane or via said ground connection (21) on the other side of the windowpane (23) so that the heating current 24 in said heating field (2) and the compensating direct current in said connecting conductor (41) flow in opposite directions.

12. The antenna according to claim 11, wherein said connecting conductor (41) is a conductor imprinted on the windowpane (23) and extends from one side of the windowpane to the other side of the windowpane with sufficiently large spacing from the electrically conductive frame so that there is virtually no interference extending from the electrically conductive frame of the windowpane.

13. The antenna according to claim 11, wherein said heating field (2) is divided into at least a first partial heating field (2*a*), and a second partial heating field (2*b*), wherein said second heating field is electrically separated from said first partial heating field, and further comprising a first set of bus bars (3*a*, 4*a*) connecting said first partial heating field to the direct current heating source (25) on each side of said first partial heating field via each respective primary winding (5, 6), and a second set of bus bars (3*b* and 4*b*) connecting said second partial heating field to said direct current heating source (25) via each respective field windings (13, 14).

14. The antenna according to claim 13, wherein said first partial heating field (2*a*) and said second partial heating field (2*b*) are substantially identical in size and conduct substantially identical heating currents so that the number of turns of said primary windings (5, 6) and said field compensation windings (13, 14) are substantially identical to each other.

15. The antenna according to claim 14, wherein said at least two primary windings (5, 6) and said at least two field compensation windings (13, 14) are each designed as bifilar windings with wires extending parallel to each other.

16. The antenna according to claim 13, further comprising a conducting antenna circuit connected to said heating field or partial heating fields, wherein said antenna is formed by wire-shaped or flat wire structure located on the windowpane, near said heating field (2) or said partial heating fields (2*a*, 2*b*) and is connected at high frequency and at high resistance to said feeding network (19, 20).

17. The antenna according to claim 16, wherein said further conducting antenna circuit further comprises a transmitter having a suitable transmission ratio, said transmitter having a primary side and a secondary side, said primary side being connected to said heating field or partial heating field at high frequency and high resistance, and wherein said antenna further comprises a controllable three-pole amplifier element connected to said secondary side of said transmitter.

18. The antenna according to claim 17, further comprising a decoupling winding (39) in said at least one magnetic core (9, 10) for transformative coupling of said received signals into said further conducting antenna circuit (32), wherein the number of turns of said winding are selected based upon the capacitance of said further conducting antenna circuit (32).

19. The antenna according to claim 18, further comprising a capacitively highly resistive, controllable three pole amplifier element (26) for providing a low effective capacitance in said further conducting antenna circuit (32).

20. The antenna according to claim 16, further comprising at least one additional heating field (2*c*) that is supplied with direct heating current from said feeding network (19, 20) and is connected to said vehicle body at high frequency and high resistance wherein said partial heating fields (2*a*, 2*b*) are disposed in an upper region of said windowpane with respect to said additional heating field (2*c*).

21. The antenna according to claim 13, further comprising a further conducting antenna circuit (32), wherein said antenna (1) is formed by said heating field (2) or said partial heating fields (2*a*, 2*b*) and is wired for high frequency, and high resistance operation, so that the high frequency signal is decoupled from said heating field or said partial heating field (2*a*, 2*b*).

22. The antenna according to claim 21, wherein said further conducting antenna circuit (32) is designed to receive a plurality of frequency ranges in the long, medium, short wave, and ultra short wave ranges, and in the television transmission range.

23. The antenna according to claim 9, wherein said connecting conductor (41) is designed as a conductor imprinted on the windowpane (23) and extends from one side of the windowpane (23) to the opposite side of the windowpane and being sufficiently spaced apart from said heating field.

24. The antenna according to claim 1, wherein said at least two feed networks (19, 20) have magnetic cores (9, 10) with two primary windings (5,6) are substantially identical to each other, and are located on each side of said heating field (2).

* * * * *